US005155529A

United States Patent [19]

Rushing

[11] Patent Number: 5,155,529

[45] Date of Patent: Oct. 13, 1992

[54] DETECTION OF TRANSFER AND FUSING PROBLEMS IN ELECTROSTATOGRAPHIC MACHINES

[76] Inventor: Allen J. Rushing, Eastman Kodak Company, Rochester, N.Y. 14653-7027

[21] Appl. No.: 850,225

[22] Filed: Mar. 12, 1992

Related U.S. Application Data

[63] Continuation of Ser. No. 688,764, Apr. 22, 1991, abandoned.

[51] Int. Cl.[5] ..... G03G 21/00

[52] U.S. Cl. ..... 355/208; 355/214; 355/246

[58] Field of Search ..... 355/208, 214, 217, 246, 355/273, 274, 285

[56] References Cited

U.S. PATENT DOCUMENTS

| | | | |
|---|---|---|---|
| 4,277,162 | 7/1981 | Kasahara et al. | 355/208 |
| 4,519,695 | 5/1985 | Murai et al. | 355/246 |
| 4,563,086 | 1/1986 | Knapp et al. | 355/246 |
| 4,894,685 | 1/1990 | Shoji | 355/246 |

*Primary Examiner*—A. T. Grimley
*Assistant Examiner*—P. J. Stanzione
*Attorney, Agent, or Firm*—David A. Howley

[57] ABSTRACT

The need for adjustment of the transfer and fusing subsystems of an electrostatographic machine is determined by adjusting the machine's process control parameters until density reading of an untransferred toner image of a test patch are within specification, or are otherwise acceptable. The toner image is transferred and fused to an image receiver sheet, and deficiencies in the images on the receiver sheet indicate the need for adjustment of the transfer and/or fusing subsystems.

3 Claims, 3 Drawing Sheets

DETECTION OF TRANSFER AND FUSING PROBLEMS IN ELECTROSTATOGRAPHIC MACHINES

This is a continuation of application Ser. No. 688,764, filed Apr. 22, 1991, now abandoned.

CROSS REFERENCE TO RELATED APPLICATIONS

Reference is made to commonly assigned, copending U.S. patent application Ser. No. 07/678,395 entitled AUTOMATIC SET-UP FOR ELECTROSTATOGRAPHIC MACHINES, filed in the name of A. Rushing on Apr. 1, 1991.

BACKGROUND OF THE INVENTION

1. Field of the Invention

The invention relates to eleotrostatographic document production machines, and more particularly to the detection of the need to adjust the transfer and/or the fusing subsystems of such machines.

2. Description of the Prior Art

In electrostatographic document production machines such as printers and copiers, image contrast, and density can be adjusted by changing certain process control parameters. Such parameters most frequently include toner concentration, primary voltage $V_0$, exposure $E_0$, and development station electrode bias voltage $V_b$.

U.S. Pat. No. 4,894,685, issued Jan. 16, 1990 to Shoji, discloses a method for setting color process control parameters by forming a plurality of different density test patches in a non-transfer portion of a photoconductor. Process control parameters are set in accordance with the differences between the recorded densities and aim densities. However, control of the electrostatographic process based on the toner density on the photoconductor alone does not insure optimum images if the transfer or the fusing subsystems are out of adjustment, as errors in these subsystems will not affect the density of the test patch on the photoconductor.

Some electrostatographic machines have attempted to overcome this problem by placing the density sensor downstream of the transfer or the fusing subsystems, but these machines cannot differentiate between errors caused by the transfer and/or fusing subsystems from errors in the other subsystems which would cause an error in the amount of toner applied to the test patch on the image receiver.

U.S. Pat. No. 4,277,162, which issued to Kasahara et al. on Jul. 7, 1981, teaches process control in response to the optical density of a test patch before and after transfer to a sheet-supporting member. If the density is sufficient before transfer, and insufficient after transfer, the transfer bias will be adjusted. However, Kasahara et al. do not disclose transfer and fusing of the test patches to the copy sheet before the final density reading. Thus, the process does not provide a check of the operation of the fusing subsystem. Further, transfer characteristics to a copy sheet are generally different than transfer characteristics to the sheet-supporting member. Therefore, the Kasahara et al. device may very possibly produce false readings of the transfer efficiency to a copy sheet.

DISCLOSURE OF INVENTION

It is an object of the present invention to provide for the detection of the need for adjustment of the transfer and fusing subsystems of an electrostatographic machine.

According to one feature of the present invention, an electrostatographic machine is adjusted until density reading of an untransferred toner image of a test patch is within specification or otherwise acceptable. The toner image is transferred and fused to a receiver sheet, and deficiencies in the images on the receiver sheet indicate the need for adjustment of the transfer and/or fusing subsystems.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present invention is described below in the environment of an electrophotographic copier. At the outset, it will be noted that although this invention is suitable for use with such machines, it also can be used with other types of electrostatographic copiers or printers.

For a detailed explanation of the theory of copier contrast and exposure control by controlling primary voltage, exposure, and bias voltage, reference may be made to the following article: Paxton, Electrophotographic Systems Solid Area Response Model, 22 Photographic Science and Engineering 150 (May/June 1978).

Figure 1:
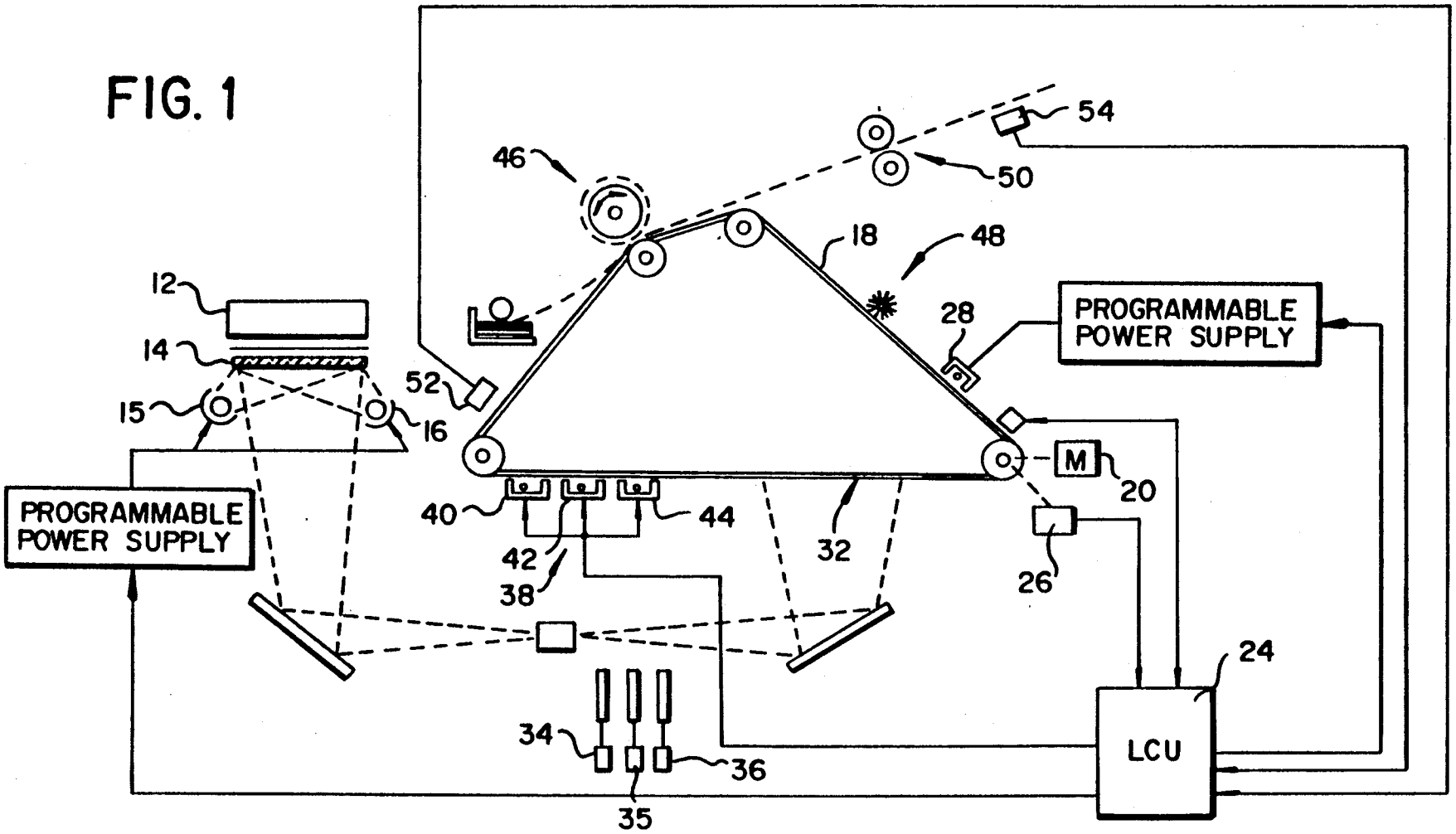
FIG. 1 is a schematic showing a side elevational view of an electrostatographic machine in which the present invention is useful.

Referring to FIG. 1, a three-color copier includes a recirculating feeder 12 positioned on top of an exposure platen 14. At exposure platen 14, originals are illuminated by a pair of xenon flashlamps 15 and 16.

Photoconductive belt 18 (one form of image member) is driven by a motor 20 past a series of work stations of the copier. The belt includes timing marks which are sensed, such as by a signal generator 22 to produce timing signals to be sent to a computer controlled logic and control unit (LCU) 24. An encoder 26 also produces timing signals for the LCU. A microprocessor within LCU 24 has a stored program responsive to signals from generator 22 and encoder 26 for sequentially actuating the work stations.

A charging station 28 applies initial voltage $V_0$ to the surface of the belt. The output of the charger is controllable by a programmable power supply 30.

The inverse image of the original is projected onto the charged surface of photoconductive belt 18 at an exposure station 32. The image dissipates the electrostatic charge and forms a latent charge image. A programmable power supply 33, under the supervision of LCU 24, controls the value $E_0$ (intensity and/or duration) of light produced by lamps 15 and 16. This, of course, adjusts the exposure of belt 18, and thereby the voltage of the photoconductor just after exposure.

The illustrated copier is adapted to reproduce three-color copies. The original is illuminated, for example, three times in succession to form three separate latent charge image frames of the original. On successive illuminations, a red filter 34, a green filter 35, or a blue filter 36 is inserted into the light path to form color separation latent charge images at exposure station 32. As understood in the art, provision may be made for a fourth exposure for areas to be developed in black, if desired. The timing of the flash of lamps 15 and 16 and the insertion of filters 34–36 are controlled by LCU 24.

Travel of belt 18 brings the areas bearing the latent charge images into a development area 38. The development area has a plurality of magnetic brush development stations, respectively containing complimentary colored toner particles, i.e., cyan particles in station 40, magenta particles in station 42, and yellow particles in station 44, corresponding to the number of formed color separation images (plus black if used), in juxtaposition to, but spaced from, the travel path of the belt.

The copier also includes a transfer subsystem 46 and a cleaning station 48, both fully described in commonly assigned U.S. patent application Ser. No. 809,546, filed Dec. 16, 1985. After transfer of the unfixed toner images to a copy sheet, such sheet is transported to a fuser subsystem 50 where the image is fixed to the sheet.

A densitometer 52 is provided to monitor development of test patches in image areas of photoconductive belt 18. The densitometer may consist of an infrared light emitting diode (LED) which shines through the belt (transmittance) or is reflected by the belt (reflectance) onto a photodiode. The photodiode generates a voltage proportional to the amount of light transmitted or reflected from a toned patch.

Figure 2:
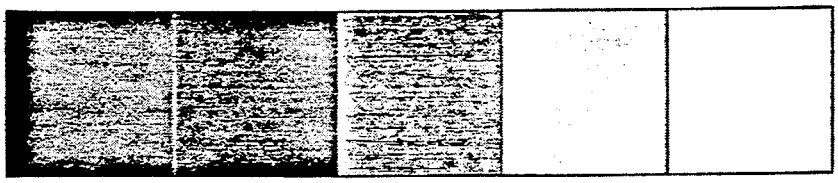
FIG. 2 is an illustration of a neutral density step tablet.

A special target document is placed on platen 14. The target document has a plurality, say five, of gray scale patches to form a neutral density step tablet shown in FIG. 2. The target document is imaged onto three frames of photoconductive belt 18 in the track of on-line densitometer 52. Each frame is toned with a different color toner, and the resultant densities are read. Process control parameter adjustments are computed on-line based on deviations of measured densities from stored aim values to provide "constant" quality of the toner image of the test patches on belt 18.

A second densitometer 54 is provided to monitor the test patches after they have been transferred to a receiver sheet at transfer subsystem 46 and fixed at fusing subsystem 50. The second densitometer may consist of an infrared light emitting diode (LED) which is reflected onto a photodiode by the receiver sheet as it leaves the fusing subsystem. The photodiode generates a voltage proportional to the amount of light transmitted or reflected from a toned patch.

Adjustments to the transfer potential and/or fusing temperature, pressure, and speed are computed on-line based on deviations of measured densities from stored aim values to provide "constant" quality of the toner image of the test patches on the receiver sheets. Alternatively, an interrupt signal may be generated to alert the operator to the need for service of the subsystems.

Figure 3:
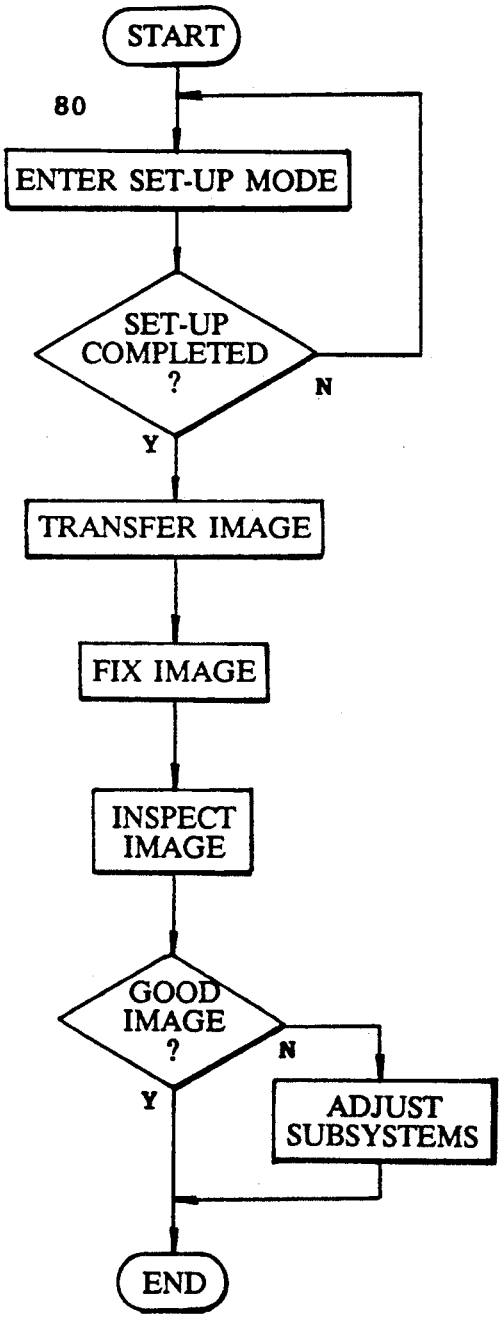
FIG. 3 is a logic flow chart of the operation of the set-up procedure according to the present invention.

Referring to FIG. 3, a suitable set-up procedure is invoked to adjust process control parameters so that a series of density test patches are produced on a transfer portion of belt 18 are within machine specifications. This procedure is represented in FIG. 3 by logic function step 80, and suitable procedures are disclosed in commonly assigned, co-pending U.S. patent application Ser. No. 07/678,395, entitled AUTOMATIC SET-UP FOR ELECTROSTATOGRAPHIC MACHINES, filed in the name of A. Rushing on Apr. 1, 1991, the disclosure of which is specifically incorporated herein by reference.

Set-up procedures will be generally iterative in nature, and when the procedure is complete, it can be assumed that the toner density test patches on the image receiver are of good quality. Once this is the case, the toner image(s) is transferred to a receiver sheet and fixed by transfer and fusing subsystems 46 and 50, respectively.

The transferred and fixed toner test patch images are inspected for quality. This can be by means of a reflection densitometer 54, other optical inspection means, or visually by an operator. If the quality is satisfactory, the transfer and fusing subsystems are assumed to be operating within specification. If the image quality is not satisfactory, appropriate adjustments can be initiated to one or more of the machine parameters that affect transfer and fusing, such as for example the transfer bias, transfer roller pressure, fusing temperature, fusing pressure, fusing speed, fusing roller lubrication, etc. Unsatisfactory performance can also be the result of using a transfer roller adapted for a different relative humidity than is being experienced.

The invention has been described in detail with particular reference to preferred embodiments thereof, but it will be understood that variations and modifications can be effected within the spirit and scope of the invention.

What is claimed is:

1. A process for detecting transfer and fusing subsystem problems in electrostatographic machines having an image member, said process comprising:

creating a toner image on the image member;

determining the quality of the toner image while the toner image is on the imaging member;

setting up the machine by adjusting process control parameters to improve the quality of toner images on the image member and to obtain a high quality toner image on the image member;

transferring the high quality toner image from the image member to a receiver sheet;

fixing the transferred toner image to the receiver sheet; and inspecting the fixed image for quality, whereby deficiencies in the images on the receiver sheet indicate the need for adjustment of the transfer and/or fusing subsystems.

2. A process as defined in claim 1 wherein said inspecting step includes comparing the density of the fixed toner image to an aim value.

3. A process for detecting transfer and fusing subsystem problems in electrostatographic machines having an image member with image areas and non-image areas, said process comprising:

creating a toner image on the image member;

determining the quality of the toner image while the toner image is on the imaging member;

setting up the machine by adjusting process control parameters to improve the quality of toner images in an image area of the image member and to obtain a high quality toner image on the image area of the image member;

transferring the high quality toner image from the image member to a receiver sheet;

fixing the transferred toner image to the receiver sheet; and inspecting the fixed image for quality, whereby deficiencies in the images on the receiver sheet indicate the need for adjustment of the transfer and/or fusing subsystems.

* * * * *